United States Patent [19]

Dotson

[11] Patent Number: 4,577,689

[45] Date of Patent: Mar. 25, 1986

[54] METHOD FOR DETERMINING TRUE FRACTURE PRESSURE

[75] Inventor: Charles E. Dotson, Houston, Tex.

[73] Assignee: Completion Tool Company, Houston, Tex.

[21] Appl. No.: 644,043

[22] Filed: Aug. 24, 1984

[51] Int. Cl.[4] ..... E21B 47/06; E21B 33/16

[52] U.S. Cl. ..... 166/250; 166/285; 166/291; 166/371; 166/386; 166/387

[58] Field of Search ..... 166/250, 285, 290, 291, 166/281, 308, 317, 381, 386, 387; 73/155

[56] References Cited

U.S. PATENT DOCUMENTS

| | | | |
|---|---|---|---|
| 2,923,358 | 2/1960 | Hildebrandt | 73/155 X |
| 3,347,319 | 10/1967 | Littlejohn | 166/290 X |
| 4,005,750 | 2/1967 | Shuck | 166/250 X |
| 4,436,151 | 3/1984 | Callihan et al. | 166/317 X |
| 4,440,226 | 4/1984 | Suman, Jr. | 166/250 |
| 4,453,595 | 6/1984 | Lagus et al. | 166/250 |

FOREIGN PATENT DOCUMENTS

| | | | |
|---|---|---|---|
| 2040342 | 8/1980 | United Kingdom | 166/317 |
| 732500 | 5/1980 | U.S.S.R. | 166/317 |

*Primary Examiner*—George A. Suchfield

[57] ABSTRACT

A method for determining true fracture pressure of earth formations disposed below a liner or casing cemented in place comprising the location of an elastomer sealing element cemented in place against the borehole wall at the bottom of the liner or casing and just above the casing shoe so as to prevent annular migration of liquids in the seal interface with the earth formations and to permit true fracture pressure of the formations to be determined.

6 Claims, 5 Drawing Figures

METHOD FOR DETERMINING TRUE FRACTURE PRESSURE

FIELD OF THE INVENTION

This invention relates to methods of determining true fracture pressure of earth formations below a liner or casing cemented in place, and more particularly, to providing an effective sealing interface with the earth formations just above the bottom end of the liner or casing so that the pressure applied in determining formation fracture pressure is representative of true pressure applied to the formation.

In the drilling of the boreholes, a weighted control fluid commonly called "mud" is utilized to control pressure, lubricate the bit and return earth cuttings to the surface. The real significance of the mud which contains fibrous materials and additives is to protect the borehole and where permeable formations are encountered, to form an impermeable filter cake on the permeable section of the well bore. The weight of the mud, however, is related to the strength of the formations in that the mud weight can produce downhole hydrostatic pressure in excess of the strength of the formation which can result in formation fracturing and loss of mud (and pressure) as well as cause borehole damage. The objective therefor is to select an appropriate mud weight which will maintain the hydrostatic pressure of the mud (which is a function of the mud weight) greater than pressures existent in porous and permeable earth formations containing gas or liquids and yet not exceed the intrinsic strength of the formations traversed by the borehole.

As the depth of the borehole increases, downhole formation pressures typically increase and, in turn heavier weight muds for well control can be required. Also as the depth of the borehole increases, the intrinsic strength of the formation increases so that heavier weight muds can be used without adversely affecting the formations. By determining the pressure that a formation can withstand without fracturing just below a liner or casing, it is reasonable to predict that the formations below will withstand the determined pressure and the maximum mud weight which can be used in drilling the formations below the liner or casing can be determined relative to the determined fracture pressure for the formations just below the liner.

Since the mud weight and the hydrostatic pressure it generates are interrelated to the depth of drilling, if the minimum fracture pressure of the formations to be drilled can be reliably determined, the maximum weight of mud which can be employed can be determined which results in an optimization of casing size and borehole drilling depth thereby reducing the costs of drilling.

In the development of an oil well it is customary to first drill a large diameter borehole from the earth's surface for several thousand feet and then cement a so-called surface casing in the drill borehole by injecting cement up through the annulus between the open borehole and the outer surface of the surface casing. Next, a smaller diameter drill bit is utilized through the surface casing to drill a second and deeper borehole into the earth formations which has a smaller diameter than the diameter of the surface borehole.

With respect to the borehole drilled below a surface casing, at an appropriate depth the drilling of the borehole is discontinued and a string of pipe commonly called a casing or liner is inserted through the surface casing. As a matter of nomenclature, a liner is a string of pipe typically suspended in the lower end of the surface casing by a liner hanger so that the lower end of the liner does not touch the bottom of the borehole and the liner thus is suspended by the tension of the pipe weight. In some instances, a liner is set on the bottom of the borehole but its upper end does not extend to the earth's surface. A casing on the other hand is a string of pipe which extends up to the earth's surface.

The casing disposed within a surface casing typically carries with it a bottom casing shoe and float and landing collars which are utilized in passing cement through the casing to cement the annulus between the casing and the borehole up to the overlap between the casing and the surface casing or to a desired depth. When the cementing operation is completed there is a column of cement in the annulus and the casing.

It is necessary in the drilling operation for deep wells to utilize successively smaller diameter pipe as a function of depth because of the weight of pipe involved and maintaining the borehole wall integrity as well as utilizing different weights of drilling mud. As discussed, the drilling muds which are utilized in the drilling operation are intended to provide a hydrostatic pressure which is in excess of the pressure expected to be encountered in a pressurized formation as well as to assist in the drilling operations. The operation of drilling through successively smaller diameter pipe and setting each liner or a casing is, of course, a function of many factors including the depth of the well and the types of formations encountered. The purpose of the cementing of the pipe in place is not only to provide support for the pipe in the well bore but to provide an effective seal between the cement and the pipe and between the cement and the earth formations so that fluid will not migrate between either of the annular interfaces of the column of cement. Thus, it is common in the drilling operations to locate the bottom of the pipe in an impermeable zone of earth formations with good strength characteristics in preference to permeable earth formations or earth formations which are not consolidated. When a pipe is cemented in place it is customary to drill a test borehole 5 to 10 feet below the end of the pipe and to pressure up the fluid in the test borehole below the pipe to determine at what pressure value the formations will fracture. By determining the fracture pressure, the weight of the drilling mud can be appropriately adjusted to be below the fracture gradient of the earth formations for the drilling of the next section of the borehole. The weight of the mud is, of course, desired to be as light as possible to enhance the drilling rate yet adequate to maintain well control. The mud is typically monitored for formation changes and adjusted during drilling to the formation parameters. By knowing the true fracture gradient, the driller can establish the maximum mud weight which can be used before another pipe is required in the borehole. This is also useful in the proper control of a gas kick and the resultant pressures on a casing shoe.

However, if the interface between the cement column and the earth formations and between the cement and pipe is not tightly sealed, upon the application of pressure to determine the fracture gradient, the fluid can migrate up the annular space and into permeable formations or into weaker formations so that a false indication of fracture pressure is obtained which is substantially lower than the actual fracture pressure of the formations. Thus the calculations for determining the maximum mud weight and the length of the next section of the borehole to be drilled is affected by the erroneous determination of the fracture pressure. As a result, the number of different diameter pipe and the size of the pipe may be more or greater than is necessary, resulting in increased drilling costs.

THE PRESENT INVENTION

The present invention provides a positive elastomeric seal cemented in place with respect to the earth formations and a pipe at a location just above the lower end of the pipe so that fluid migration along the formation/cement interface or the cement/pipe interface is effectively prevented and thereby permitting the true fracture pressure of a formation to be obtained with a fracture pressure test. This is achieved by utilizing an inflatable packer element located just above the lower end of the casing shoe on the pipe and in the cementing operation by passing cement into the annulus between the pipe and the borehole until the pipe is cemented in place and thereafter while the cement remains unset, inflating an inflatable packer element with cement for compressing the earth formations under pressure and compressing the elastomeric element into a tight seal with respect to the earth formations. After the cement has set, the formations above the packing element are effectively sealed off with respect to the formations below the packing element so that there is no loss of fluid or pressure by virtue of leakage along the sealing interfaces between the cement and formation and between the cement and pipe.

The above invention will become more apparent when taken in connection with the following description and drawings in which.

DESCRIPTION OF THE INVENTION

Figure 1:
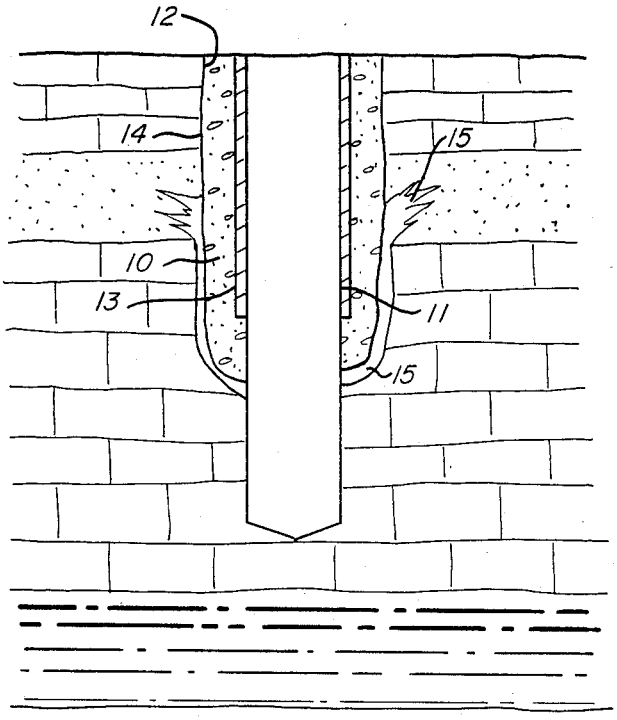
FIG. 1 is a partial view of the lower end of a liner cemented in place without benefit of an inflatable packer and illustrating the nature of a seal failure.

Referring to FIG. 1, in a typical cementing operation for a liner or casing pipe in an open borehole, a cement slurry is pumped under pressure through the pipe to fill the annulus between the liner or pipe 11 and the borehole 12. After the cement slurry has set or hardened, it forms an annular load supporting column of cement 10 between the intended to bond or seal at the cement/pipe interface liner or casing pipe 11 and the borehole 12 and is 13 and at the cement/borehole interface 14 and prevent fluid or liquid migration along the interface. Because the pipe has a better bonding surface the cement-/pipe interface is more likely to provide a good seal. The cement/borehole interface is more subject to failure because the borehole wall may have a mudcake lining formed by the drilling mud utilized in drilling to maintain well control and the mudcake lining typically has a slick surface. Additionally, the cement column may shrink too much in volume upon setting (because of hydration and filtrate loss) and consequently the radial loading on the borehole can be reduced so that the cement separates or does not tightly seal at either interface. Also vertical channeling of the cement column may occur for a number of reasons. Failure of the cement column to provide an effective seal permits fluid or liquid migration and fluid under pressure in the well can migrate to porous formations or formations with weak strength properties.

In any event after cementing, any cement left in the pipe 11 as well as the destructible cementing equipment such as the casing shoe, float collar and landing collars are subsequently reamed or drilled out to project or deepen the borehole below the lower cemented end of the pipe. After a test borehole is obtained below the cemented pipe, the liquid or mud in the borehole is pressured up to determine the fracture pressure of the formation traversed by the open test borehole below the pipe. The true fracture pressure is important because the drilling weight of the mud for the next section of borehole, the length of pipe considerations and the depth of drilling of the next section are principally based upon the fracture pressure test. The problem in obtaining true fracture pressure is that when fluid under pressure is applied in the pipe 13, if the fluid migrates through the cement/borehole interface or between the cement/pipe interface or through channels, the migration can reach weaker formations or can reach porous formations. Thus, the fracture pressure determination in such instance is much lower than the actual fracture pressure of the formation which contains the borehole. The migration of fluid is illustrated in the drawing by the area identified as number 15.

Figure 2:
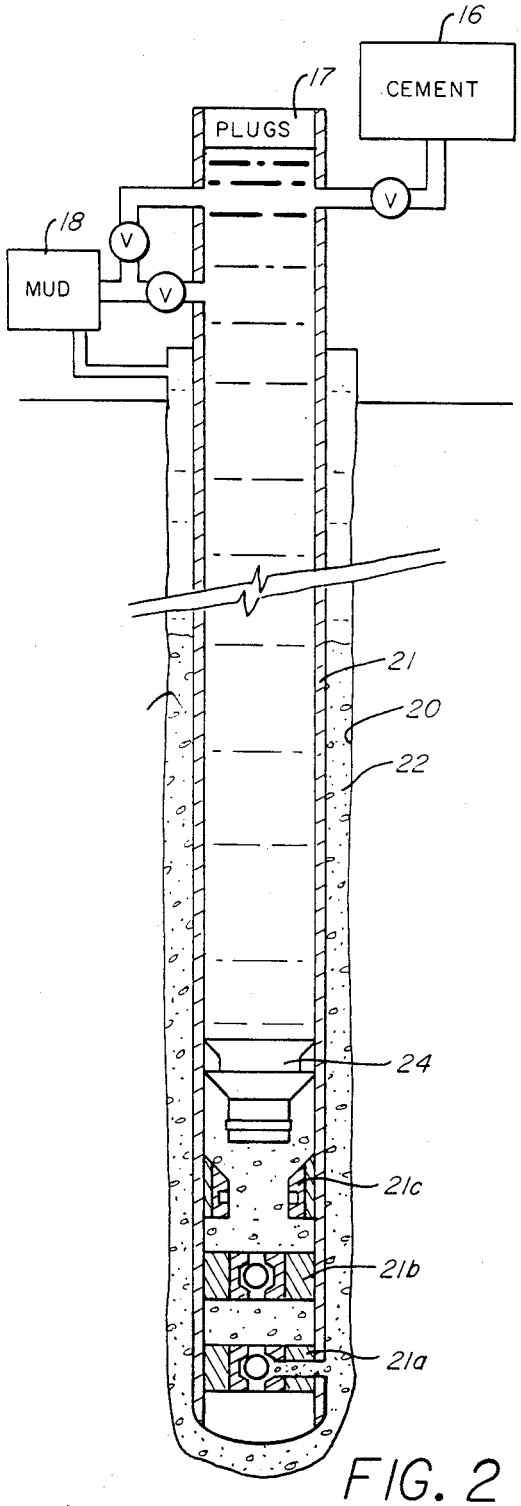
FIG. 2 is a schematic illustration of cementing a surface casing in place.

Referring now to FIG. 2 and with respect to the present invention, a first, large diameter borehole 20 traversing earth formations is illustrated. A surface casing 21 is cemented in place by a column of cement 22 disposed between the borehole 20 and the casing 21. The casing 21 is illustrated as a surface casing which typically is set in place for an interval of two to three thousand feet from the earth's surface or as required by State or Federal regulations.

In cementing the casing 21 in the borehole 20, a cement slurry is pumped through the bore of the casing 21 after the casing 21 is positioned in the borehole 20 by injecting a cement slurry from a source of cement and cementing equipment 16. The flow of cement is controlled by a valve. The cement slurry may be preceded, if desired, by a slidable plug (not shown) injected from a plug head 17 into the casing 21. The plug is moved by drilling mud applied under pressure from mud pumping equipment 18 to slidable plug 24 to move the cement slurry. The cement slurry is passed through a cementing shoe **21*a* and float collar 21*b* until the plug 24 latches in a landing collar 21*c*. After the cement has set up or hardened, the plug 24, collars 21*c*, 21*b* and shoe 21*a*** (which are destructable) are drilled out to form the next section of borehole. All of the foregoing is conventional and well known.

Figure 3:
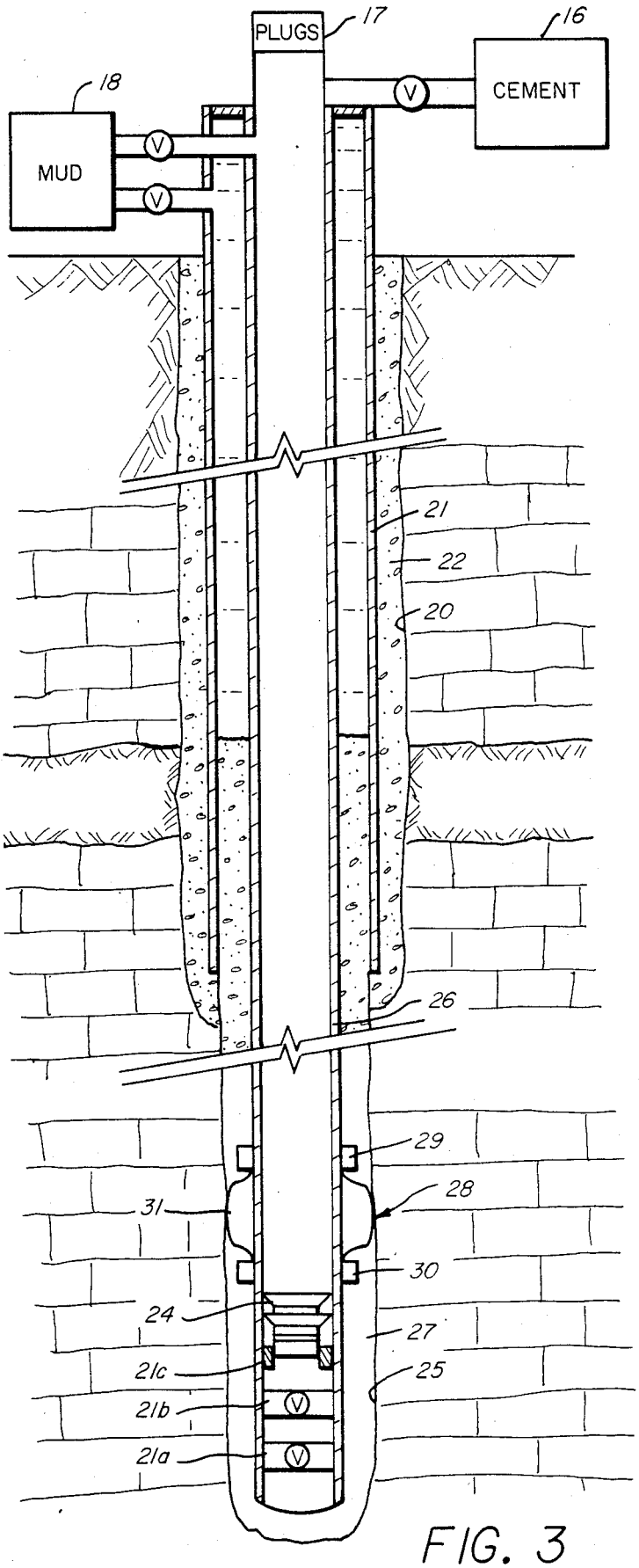
FIG. 3 is a schematic illustration of a typical borehole configuration for cementing of a casing in position the present invention.

A second smaller diameter borehole 25 is illustrated in FIG. 3 below the borehole 20. The second borehold 25 is drilled after the casing 21 is set in place and cemented, by drilling through the casing 21 to the next desired depth of the borehole. As will be appreciated, the weight of the casing involved in casing a section of borehole is significant and the weight of the drilling mud is typically increased to provide adequate well control by providing a downhole pressure greater than the pressure in an oil or gas formation. The weight of the mud, which affects the downhole hydrostatic pressure, must be controlled to be below the fracture pressure of the earth formations traversed by the borehole or the pressure will fracture the formations and result in loss of fluid into the fractured formations or leak along a separated interface which can result in loss of well control and, in some instances, adversely affect the integrity of the borehole.

The borehole 25 receives a casing 26 which also is cemented in place, the cement column 27 filling the annulus between the casing 26 and the borehole 25. At the lower end of the casing 26 is an inflatable packer 28 which includes an upper valve collar 29, a lower collar 30 and an elongated, tubular, elastomer sealing element 31 connected to the collars 29, 30. The inflatable packer 28 is shown in an inflated condition where cement is in the interior of the packing element 31 and compresses the packing element 31 in sealing engagement against the wall of the borehole 25. The packing element 31 provides a positive seal with respect to the borehole wall and is sealed off with respect to the casing 26 at the collar 30. Details of the functioning and structure of the inflatable packer 28 can be found in U.S. Pat. No. 4,420,159, issued to Edward T. Wood on Dec. 13, 1983, to which reference may be made.

Figure 4:
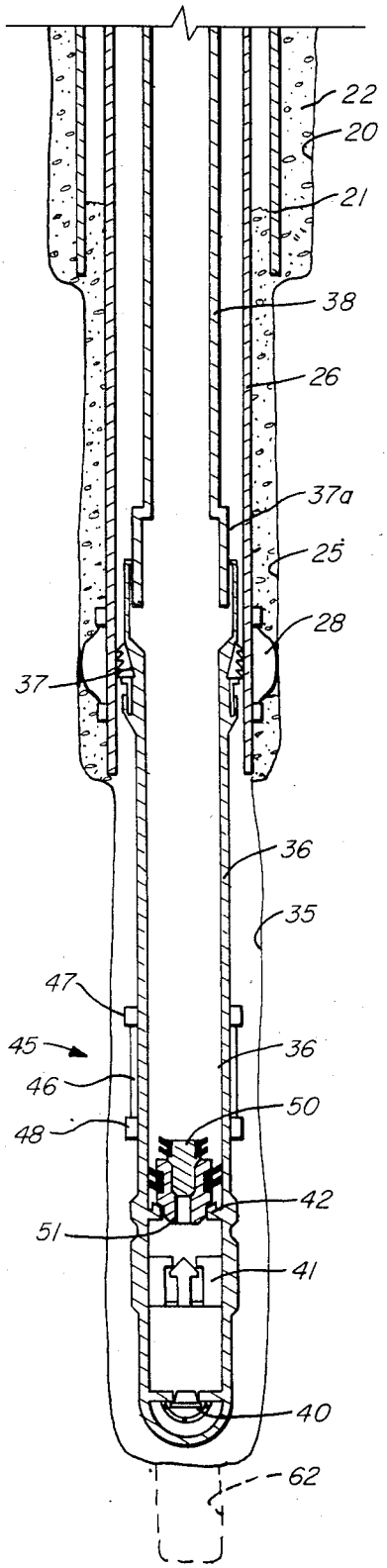
FIG. 4 is a schematic illustration of a typical borehole configuration for cementing a liner in position utilizing the present invention.

Refering now to FIG. 4, a third, still smaller borehole 35 is illustrated below the second borehole 25. The third borehole 35 is drilled after the casing 26 is set in place by drilling through the casing 26 to the next desired depth of the borehole. Before drilling the borehole 35 or the borehole 25, a fracture test can be performed to determine fracture pressure of the formations immediately below a pipe and for designing the mud weight and pipe for the next section of borehole as will be explained hereafter in connection with the liner 36.

Figure 5:
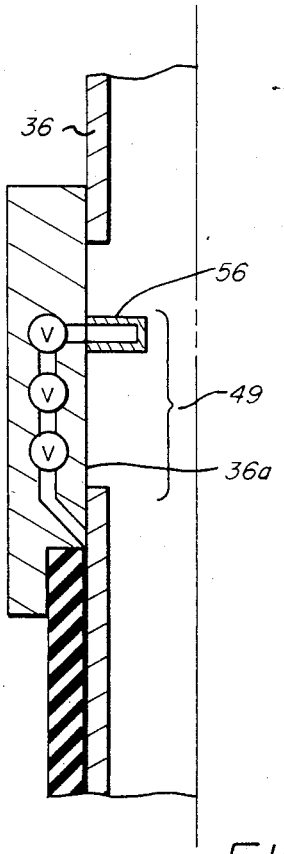
FIG. 5 is a partial view of a valve collar of an inflatable packer.

A liner string of pipe 36 is disposed in the borehole 35 and is typically suspended in tension above the bottom of the well bore by a conventional liner hanger 37 by use of a setting tool 37*a* and tubing string 38 which extends to the earth's surface. There is typically an overlap of 50 feet or more between the telescoped casing and liner 26 and 36. The liner 36 carries at its lower end a casing shoe 40, a float collar 41 and a landing collar 42 which are typical standard components for a cementing operation. The landing collar 42 may be a part of the float collar 41 in some instances. The cement shoe 40 and float collar 41 act as one way valves to prevent return of fluid or cement into the casing 36. Just above the landing collar 42 is an inflatable packer 45 shown in a deflated condition with the packing element 46 adjacent the casing 36 and sealingly attached to the upper valve collar 47 and lower collar 48. The valve collar 47 typically has a valve system of three valves (shown schematically in a partial view at 49 in FIG. 5) in a passageway extending between the interior bore 36*a* of the casing 36 to the interior of the packing element 46. The passageway opening to the bore of the casing 36 is initially closed by a knock-off plug 56.

In the cementing of liner 36 a cement slurry is injected ahead of a dart 50. Initially the wiper plug 51 is disposed just below the setting tool and when the dart 50 enters the open bore of the wiper plug 51, the plug 51 is closed off and travels downward in the liner 36 displacing the cement slurry until the plug 51 sets in the landing collar 42. At this time the column of cement slurry should extend upwardly in the annulus between the borehole 35 and liner 36 to overlap the annulus between liner 36 and the casing 26 and an injection volume of cement is above the dart 50.

When the plug 51 passes the knock-off plug 56 in the valve collar 47 the plug 56 is removed. Thereafter when the dart and plug bottom out on the landing collar 42, the pressure on the cement column is increased to the predetermined shear value of the valve system 49 which opens the passageway in the valve collar 47 and the inflation volume of cement slurry inflates the packing element 46 into sealing contact with the wall of the borehole before the cement sets. The inflation pressure is such that upon setting of the cement, the packing element 46 remains compressed between the cement in the interior of the packing element and the borehole wall.

After cementing the liner 36 and the cement has set up, a drilling bit removes the cement remaining in the liner 36 as well as the plugs, landing collar, float shoe and cement shoe and a further extension of the borehole is made by drilling below the cement in the earth formations (shown by dashed line 62) using a drilling mud. After drilling the borehole extension 62, the mud in the pipe is subjected to pressure applied at the earth's surface from the mud source until the fracture pressure of the earth formations traversed by the borehole extension 62 is determined. Because of the positive seal of the packing element 46, no fluid or liquid migration can occur and thus true fracture pressure can be determined.

In practicing the method as described above, the driller obtains logs from time to time and/or evaluates the cuttings returned to the earth surface. The logs and/or cuttings provide data as to the strength of the formations being traversed by the drilling bit. Where available, correlation with surrounding known geological data from other wells and seismic surveys, the expected pressures and types of earth strata can be anticipated for the drilling program. Thus, the obtaining of true formation fracture pressure enables maximization of mud weights and depth of drilling per section of casing.

It will be apparent to those skilled in the art that various changes may be made in the invention without departing from the spirit and scope thereof and therefore the invention is not limited by that which is enclosed in the drawings and specifications but only as indicated in the appended claims.

What is claimed:

1. A method for determining the fracture pressure of earth formations below a cemented liner in a well bore comprising the steps of:

lowering a liner into a well bore containing well control liquid where the liner has a destructable cementing equipment including a casing shoe at the end of the liner and an inflatable packer with an elastomer packing element located proximate to the casing shoe until the casing shoe is located just above the bottom of the well bore;

hanging the liner in tension in the next above pipe to provide an overlap of the liner and next-above pipe;

connecting a string of pipe to the top of the liner and injecting a volume of cement through the liner by using a well control fluid under pressure behind the volume of cement and displacing the well control fluid in the well bore in front of the volume of cement through the annulus between the liner and the well bore until the cement fills the annulus between the liner and the well bore and the lower end of the liner above the inflatable packer;

before the cement sets, inflating the inflatable packer with cement in the liner under pressure for compressing the packing element between the cement and wall of the borehole and for stressing the earth formations contacted by the packing element of the inflatable packer;

after the cement sets, drilling through the cementing equipment in the liner for removing the casing shoe and drilling into the earth formations below the end of the liner;

applying pressure to the well control fluid in the liner until the fracture pressure of the earth formations below the liner is determined.

2. The method as set forth in claim 1 and further including the step of discontinuing the application of pressure immediately following the determination of the fracture pressure.

3. A method for determining the fracture pressure of earth formations below a cemented liner in a well bore comprising the steps of:

lowering a liner into a well bore containing well control liquid where the liner has a destructable cementing equipment including a casing shoe at the end of the liner and an inflatable packer with an elastomer packing element located proximate to the casing shoe until the casing shoe is located just above the bottom of the well bore;

hanging the liner in tension in the next above pipe to provide an overlap of the liner and net-above pipe;

connecting a string of pipe to the top of the liner and injecting a volume of cement through the liner by using a well control fluid under pressure behind the volume of cement and displacing the well control fluid in the well bore in front of the volume of cement through the annulus between the liner and the well bore until the cement fills the annulus between the liner and the well bore and the lower end of the liner above the inflatable packer;

before the cement sets, inflating the inflatable packer with cement in the liner under pressure for compressing the packing element and for stressing the earth formations contacted by the packing element of the inflatable packer;

after the cement sets, drilling through the cementing equipment for removing the casing shoe and obtaining access to the earth formations below the end of the liner;

applying pressure to the well control fluid in the liner until the fracture pressure of the earth formations below the liner is determined.

4. The method as set forth in claim 3 and further including the step of immediately discontinuing the application of pressure following the determination of the fracture pressure.

5. A method for determining the fracture pressure of earth formations below a cemented pipe in well bore comprising the steps of:

lowering a pipe into a well bore containing well control liquid where the pipe has a casing shoe and an inflatable packer with an elastomer packing element located proximate to the casing shoe until the casing shoe is located just above the bottom of the well bore;

injecting a volume of cement through the pipe by using a well control fluid under pressure behing the volume of cement and displacing the well control fluid in the well bore in front of the volume of cement through the annulus between the pipe and the well bore until the cement fills the annulus between the pipe and the well bore and the lower end of the pipe above the inflatable packer;

before the cement sets, inflating the inflatable packer with cement in the pipe under pressure for compressing the packing element between the cement and wall of the borehole and for stressing the earth formations contacted by the packing element of the inflatable packer;

after the cement sets, removing the casing shoe and obtaining access to the earth formations below the end of the liner; and applying pressure to the well control fluid in the pipe until the fracture pressure of the earth formations below the pipe is determined, and discontinuing the application of pressure upon determining the fracture pressure.

6. A method for determining the fracture pressure of earth formations below a cemented pipe in a well bore comprising the steps of:

lowering a pipe into a well bore containing well control liquid where the pipe has a casing shoe and an inflatable packer with an elastomer packing element located proximate to the casing shoe until the casing shoe is located just above the bottom of the well bore;

injecting a volume of cement through the pipe by using a well control fluid under pressure behind the volume of cement and displacing the well control fluid in the well bore in front of the volume of cement through the annulus between the pipe and the well bore until the cement fills the annulus between the pipe and the well bore and the lower end of the pipe above the inflatable packer;

before the cement sets, inflating the inflatable packer with cement in the pipe under pressure for compressing the packing element between the cement and wall of the borehole and for stressing the earth formations contacted by the packing element of the inflatable packer;

after the cement sets, drilling through the cement in the pipe for removing the casing shoe and drilling a test borehole into the earth formations below the end of the liner;

applying pressure to the well control fluid in the pipe until the fracture pressure of the earth formations below the pipe is determined, and discontinuing the application of pressure upon determining the fracture pressure.

* * * * *